US012114775B1

(12) United States Patent
Ducker

(10) Patent No.: US 12,114,775 B1
(45) Date of Patent: Oct. 15, 2024

(54) PIVOTABLY DEPLOYABLE KNEE-CUSHION ASSEMBLY FOR INDOOR AND OUTDOOR USE

(71) Applicant: Andrew Leslie Ducker, Coral Springs, FL (US)

(72) Inventor: Andrew Leslie Ducker, Coral Springs, FL (US)

( * ) Notice: Subject to any disclaimer, the term of this patent is extended or adjusted under 35 U.S.C. 154(b) by 0 days.

(21) Appl. No.: 18/375,993

(22) Filed: Oct. 2, 2023

(51) Int. Cl.
*A47C 16/04* (2006.01)
*A47C 16/02* (2006.01)

(52) U.S. Cl.
CPC ..... *A47C 16/04* (2013.01); *A47C 16/025* (2013.01)

(58) Field of Classification Search
CPC ..... A47C 7/543; A47C 13/00; A47C 16/04; A47C 16/025; A47C 16/02
USPC ..... 297/DIG. 6; 24/442
See application file for complete search history.

(56) References Cited

U.S. PATENT DOCUMENTS 6,312,051 B1 * 11/2001 Adams ..... A47C 31/113 297/228.11
7,055,216 B2 * 6/2006 Seidler ..... A45D 40/24 16/320
7,320,502 B1 * 1/2008 McCloskey ..... A47C 16/04 297/DIG. 6
7,428,782 B1 * 9/2008 Beck, Jr. ..... G01C 21/22 33/DIG. 1

FOREIGN PATENT DOCUMENTS

KR 1486188 B1 * 1/2015 ..... A47C 11/00

* cited by examiner

*Primary Examiner* — Milton Nelson, Jr.
(74) *Attorney, Agent, or Firm* — Frank L. Kubler

(57) ABSTRACT

A knee-cushion assembly includes an oval forward panel and an oval rearward panel, each cushioned with high density, closed cell foam, which are pivotally interconnected to fan apart to a deployed configuration for use, and to pivot into an overlapping, closed configuration for compact storage. The panels are pivotally interconnected by a pin structure. When deployed, the front faces of both panels are presented and accessible so that a user can rest a knee on each, to protect their knees from the impact, pressure, discomfort and injury that can be caused by placing knees directly on a hard support surface such as a floor. A magnet preferably is secured to the rearward surface of the rearward panel so that the assembly can be magnetically attached to any flat steel surface.

10 Claims, 13 Drawing Sheets

PIVOTABLY DEPLOYABLE KNEE-CUSHION ASSEMBLY FOR INDOOR AND OUTDOOR USE

FILING HISTORY

This application is a continuation-in-part of application Ser. No. 17/535,292 filed on Nov. 24, 2021, issued on Oct. 3, 2023 into U.S. Pat. No. 11,771,233, which continues continued from provisional patent application Ser. No. 63/258,423 filed on May 3, 2021.

BACKGROUND OF THE INVENTION

1. Field of the Invention

The present invention relates generally to the field of knee protection devices for performing various tasks, and more specifically relates to forward and rearward cushion panels pivotally interconnected to fan apart to a deployed configuration for use, and to pivot into an overlapping, closed configuration for compact storage. The cushion panels are pivotally interconnected by a pin structure in the form of a pin, button or rivet as below-described. When deployed, the front faces of both panels are presented and accessible so that a user can rest a knee on each, to protect their knees from the impact, pressure, discomfort and injury that can be caused by placing them directly on a hard support surface, such as a floor. The panels preferably have the same shape and size, and the pin structure preferably is located closely adjacent to corresponding edges of each, so that when the panels are fanned apart on the pin structure, the front face of the rearward panel is broadly exposed, and both panel front faces are presented to each support a user knee. Then they can pivot to overlap fully and register with each other in their closed configuration.

The forward and rearward panels preferably are elliptically- or oval-shaped, with the pin structure being located adjacent a narrow end of each, so that they cover a wide area when fanned apart. The panels preferably are each formed of closed cell high-density foam. Each panel is substantially one inch thick for a consumer version, which can firmly and comfortably support knees carrying 250 pounds weight, and is substantially 1.5 inches thick for an industrial version to firmly and comfortably support knees carrying 350 pounds weight. The front face of each panel preferably is covered with a protective layer, such as of vinyl. A logo may be printed or otherwise displayed on the forward panel front face, such as on the vinyl. The back face of each panel preferably is covered with a protective layer. A magnet, preferably in the form of a flexible sheet magnet, is adhesively secured to the back face of the back panel, and has adequate magnetic force to support the assembly when placed against a steel surface, such as against the front or side of a refrigerator, or the side of a metal tool cabinet, or to an outdoor steel storage shed, so that it is easy to store, see or locate. To releasably secure the assembly in its closed configuration between uses, a locking mechanism preferably is provided. The forward and rearward panels optionally are optionally formed of UV glow-foam to glow at night and recharge from ambient light during the day.

2. Description of the Prior Art

There have long been knee-pads for protecting knees when a user kneels, such as to work on an appliance or a car, or to garden. Some prior knee-pads are sleeves which fit around the knees and thus are inconvenient to use, and typically do not provide adequate protection. Others are individual padded structures which can become separated so that both are not readily available or can be located at a given moment.

It is thus an object of the present invention to provide a pivotally deployable knee-cushion assembly having two cushion panels, each for supporting a user knee, which are interconnected so that they never become separated and both are always available.

It is another object of the present invention to provide such a knee-cushion assembly in which the two cushion panels are interconnected pivotally, so that they can fan apart to a broad configuration where both panels are presented for use, and pivot into overlapping relation to a closed configuration for compact storage, and thus has the dual benefits of broad deployment and compact storage.

It is still another object of the present invention to provide such a knee-cushion assembly with magnetic mounting means so that it can be magnetically and removably anchored to a steel surface such as the side wall of a refrigerator, side wall of a freezer located in a garage, or side wall of a rolling or non-rolling metal tool box in a garage or an interior side wall of a metal shed, so that it is easy to store, see and locate.

It is finally an object of the present invention to provide such a knee-cushion assembly which is very easy to use and inexpensive to manufacture.

SUMMARY OF THE INVENTION

The present invention accomplishes the above-stated objectives, as well as others, as may be determined by a fair reading and interpretation of the entire specification.

A knee-cushion assembly is provided, including cushioned forward and rearward panels which are pivotally interconnected to fan apart to a deployed configuration for use, and to pivot into an overlapping, closed configuration for compact storage. The panels are pivotally interconnected by a pin structure. When deployed, the front faces of both panels are presented and accessible so that a user can rest a knee on each, to protect their knees from the impact, pressure, discomfort and injury that can be caused by placing knees directly on a hard support surface such as a floor. A flexible mounting magnetic sheet preferably is secured to the rearward surface of the rearward panel so that the assembly can be magnetically mounted to a steel surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
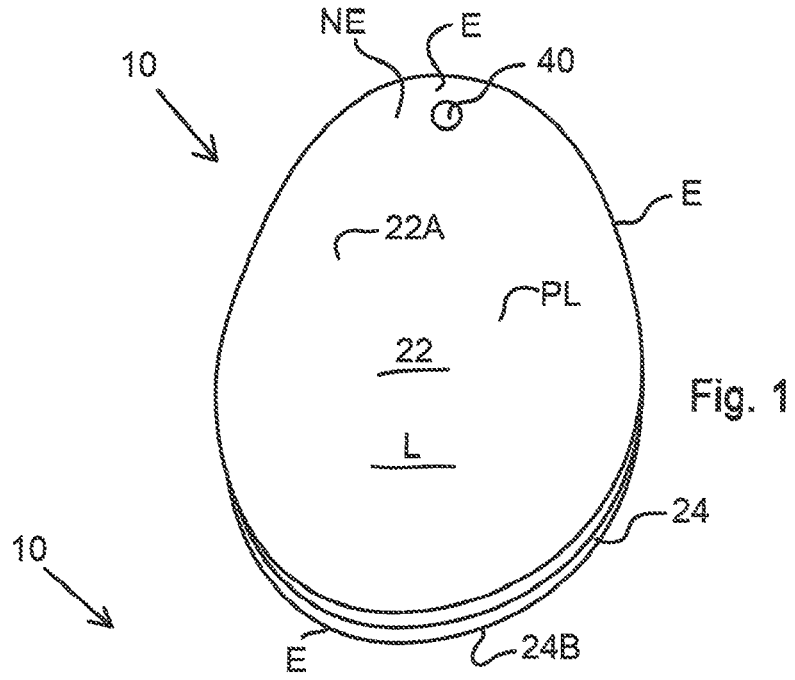
FIG. 1 is a perspective view of the assembly in its closed configuration.
Figure 2:
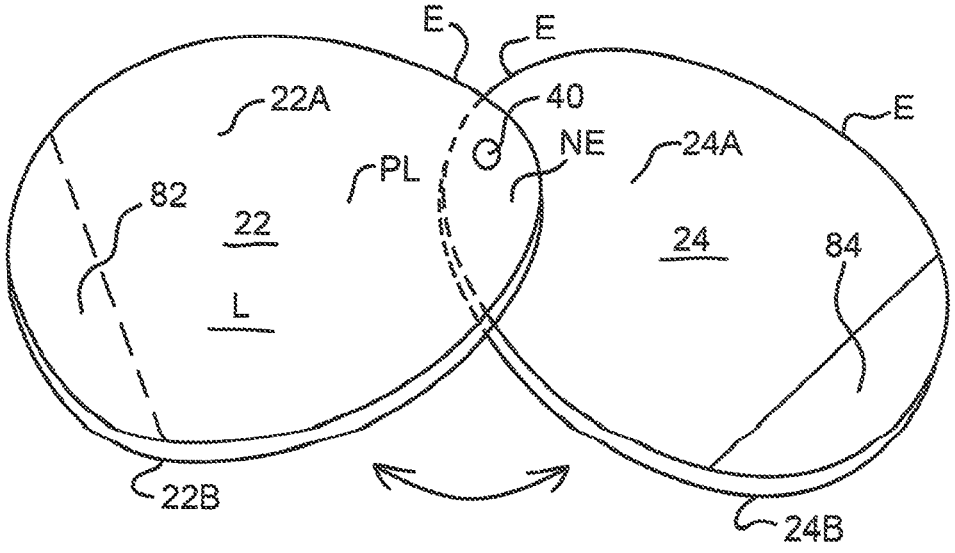
FIG. 2 is a view as in FIG. 1 of the assembly in its open configuration. The first locking magnetic sheet is shown in broken lines on the back face of the forward panel and the second locking magnetic sheet is shown in the front face of the rearward panel.
Figure 3:
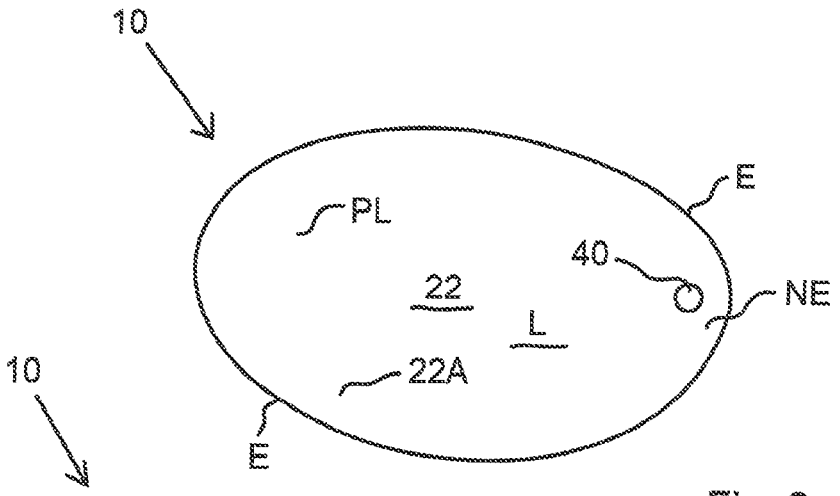
FIG. 3 is a top plan view of the assembly in its closed configuration.
Figure 4:
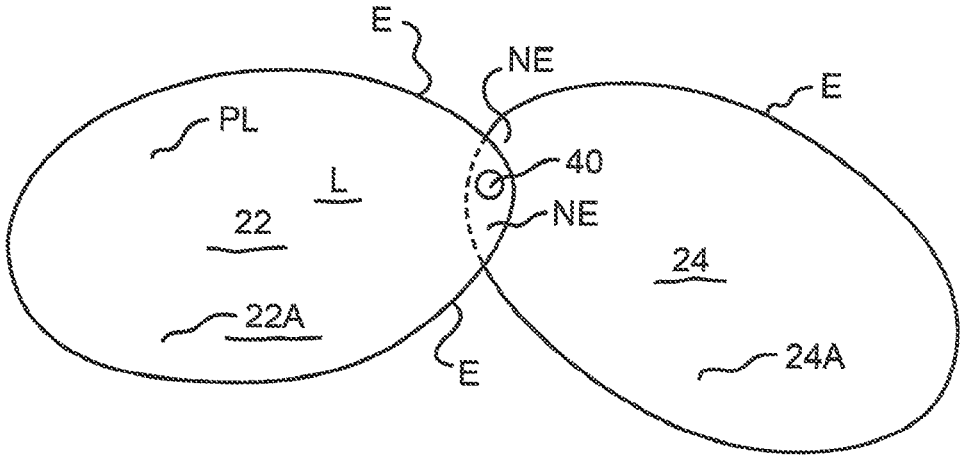
FIG. 4 is a view as in FIG. 3 of the assembly in its open configuration.
Figure 5:
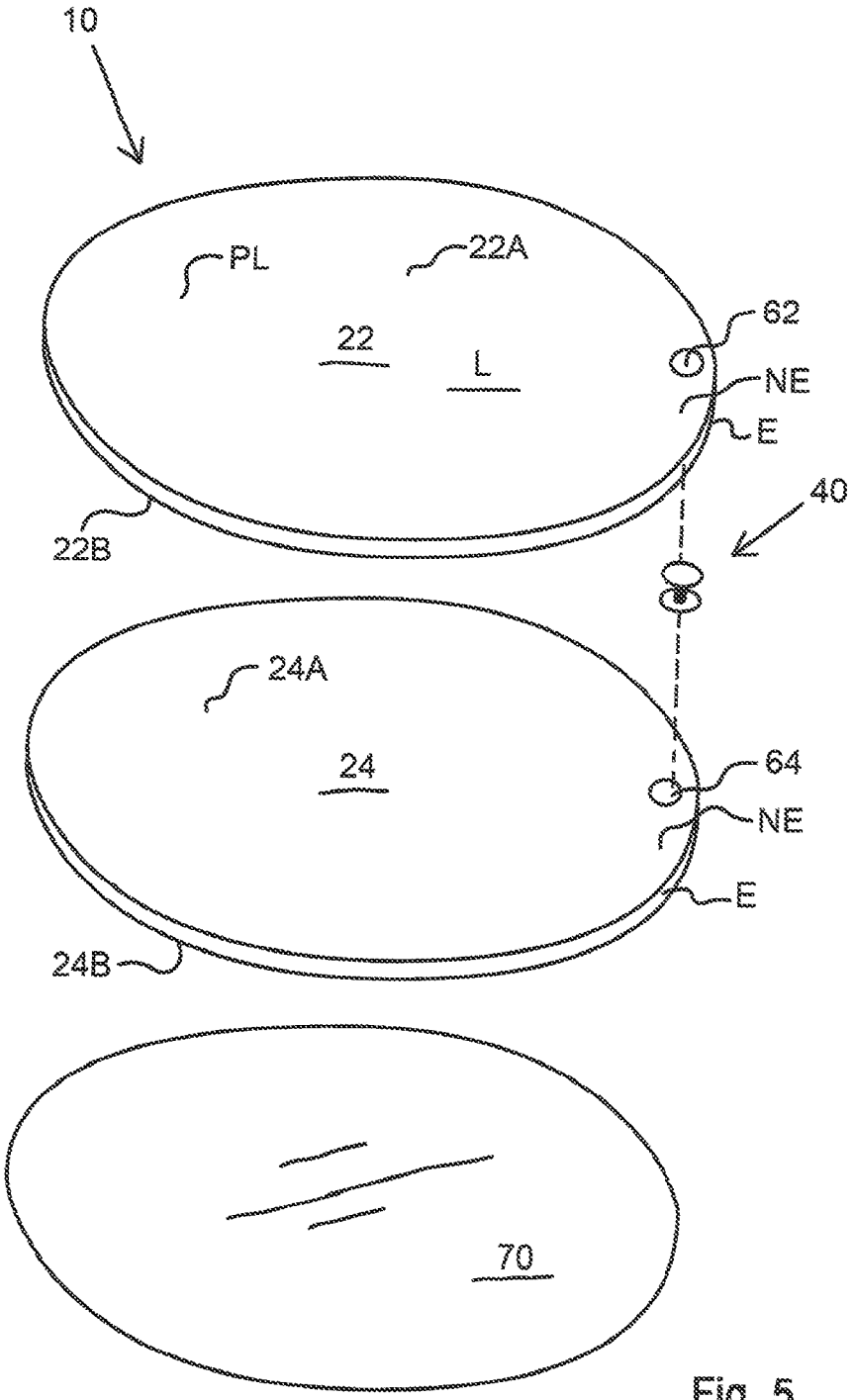
FIG. 5 is an exploded, perspective view of the assembly of FIGS. 1-4.
Figure 6:
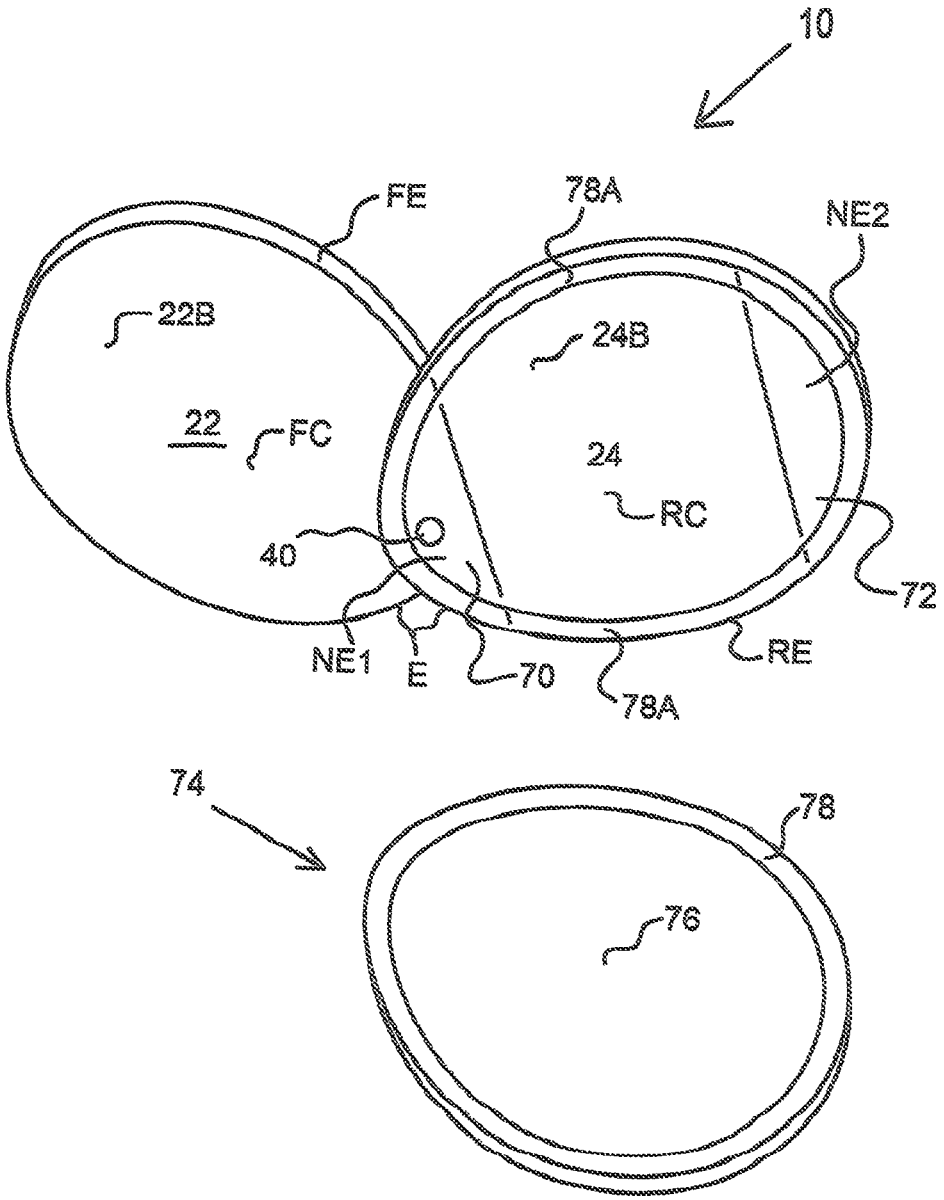
FIG. 6 is a perspective back view of the assembly, showing the first and second magnetic mounting end sheets on the back face of the rearward panel for removably mounting the assembly on an upright steel surface such as a refrigerator door. An optional cushion cover for protecting first and second magnetic mounting sheets is shown in exploded relation to the assembly.
Figure 7:
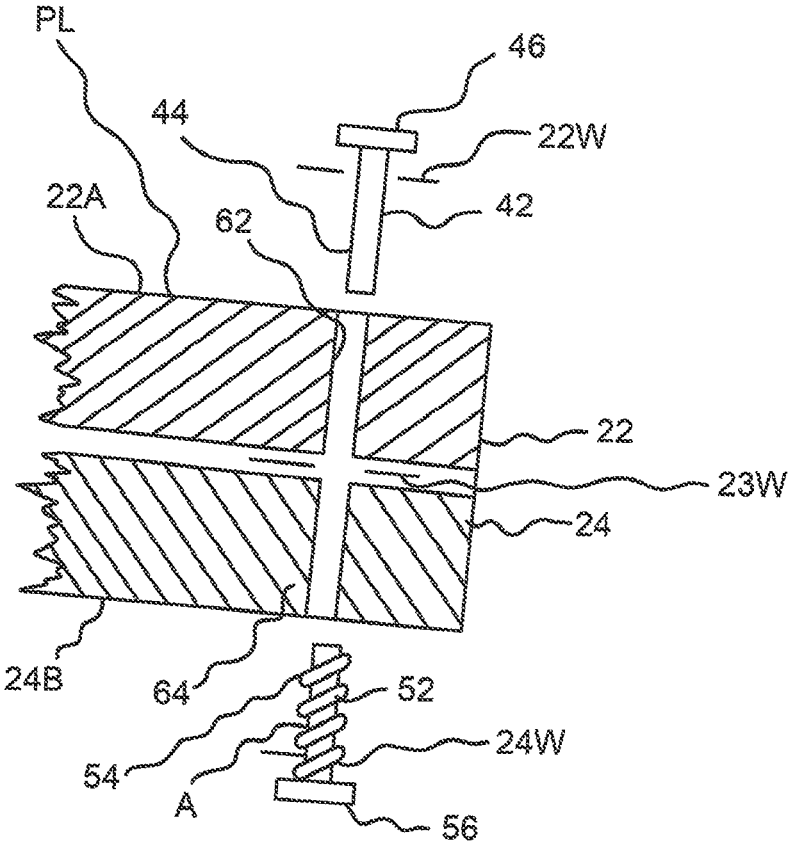
FIG. 7 is an exploded, broken-away, cross-sectional view of an end of the assembly showing the elements of the preferred pin structure.
Figure 8:
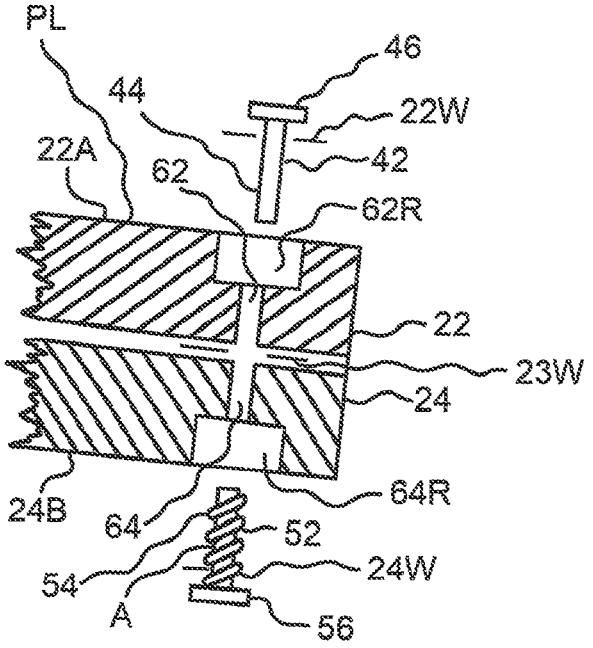
FIG. 8 is a broken away, exploded view of the pivoting end of the assembly showing the pin structure countersunk into the front face of the forward panel forming a forward recess and into the back face of the rearward panel forming a rearward recess to protect the user from contact with the pin structure during use.
Figure 9:
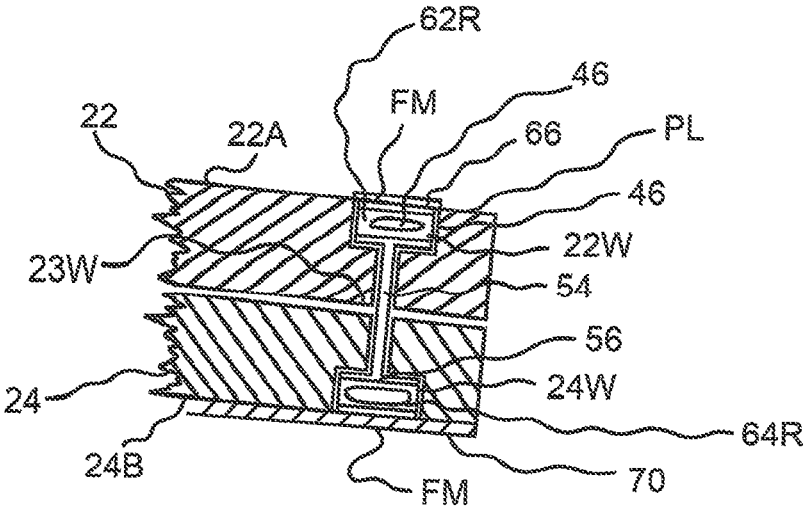
FIG. 9 is a view as in FIG. 8, but showing the assembly assembled and filler material placed into the forward and rearward recesses and a cover sheet placed over the forward recess and the second magnetic mounting end sheet covering the rearward recess.
Figure 10:
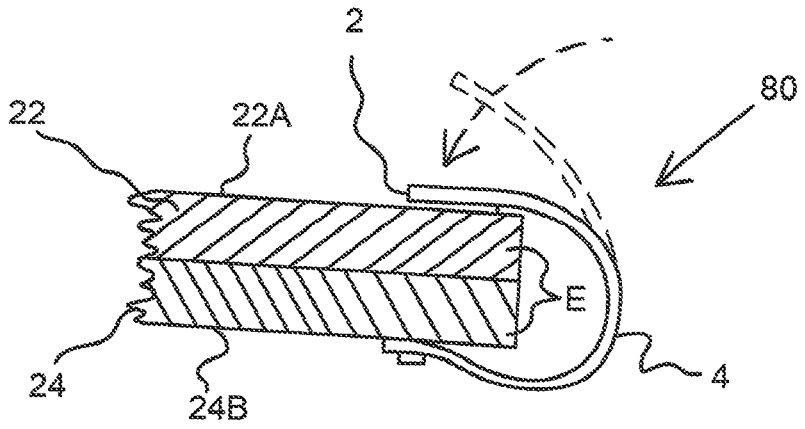
FIG. 10 is a broken-away edge view of an end of the assembly showing the locking mechanism, including the hook and loop fastener patch and strap, in the locked position.
Figure 11:
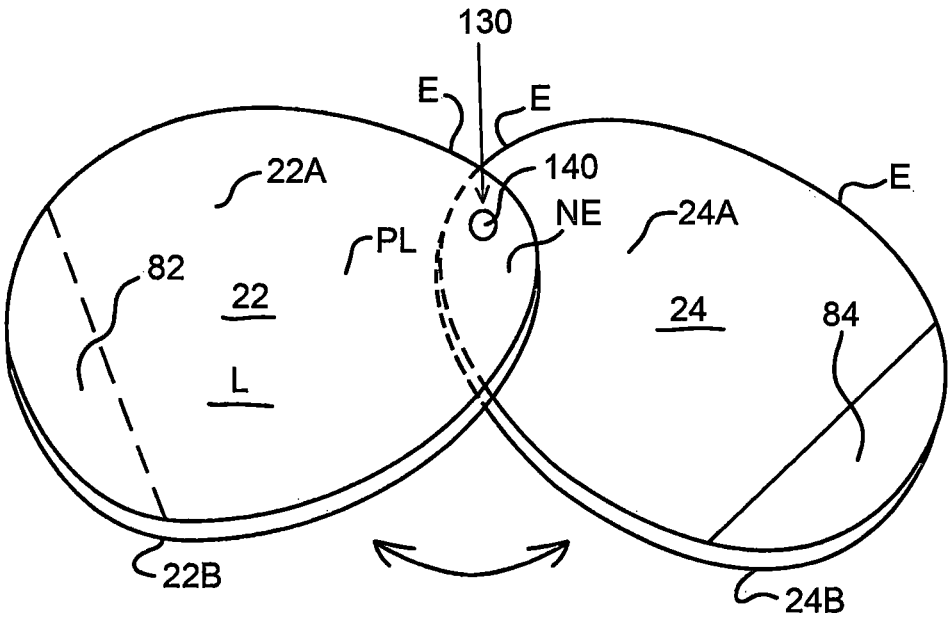
FIG. 11 is a view as in FIG. 2 but of the second embodiment of the invention.
Figure 12:
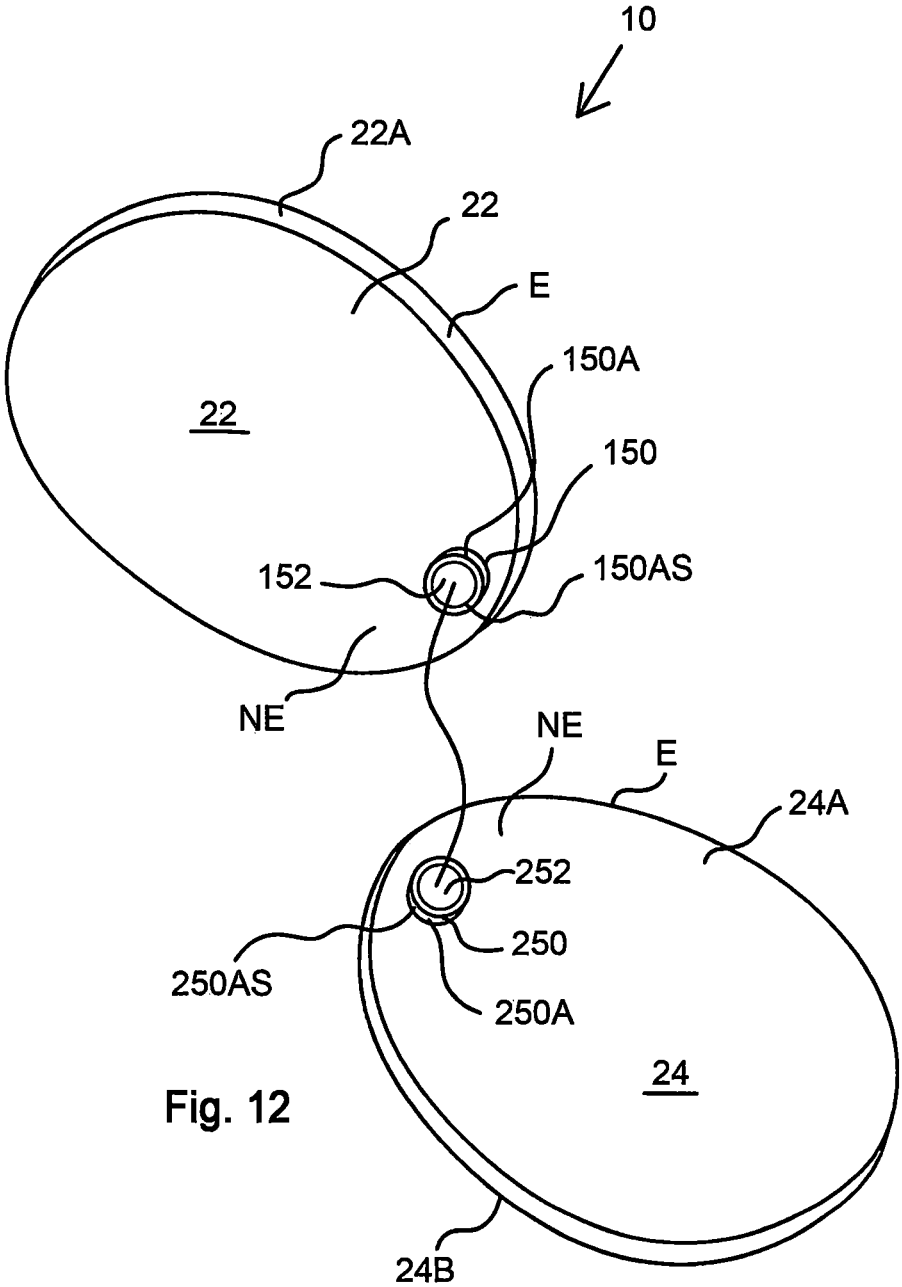
FIG. 12 is a perspective, exploded view of the assembly of the second preferred embodiment; in its fanned apart, open configuration, revealing the forward and rearward inset magnets.
Figure 13:
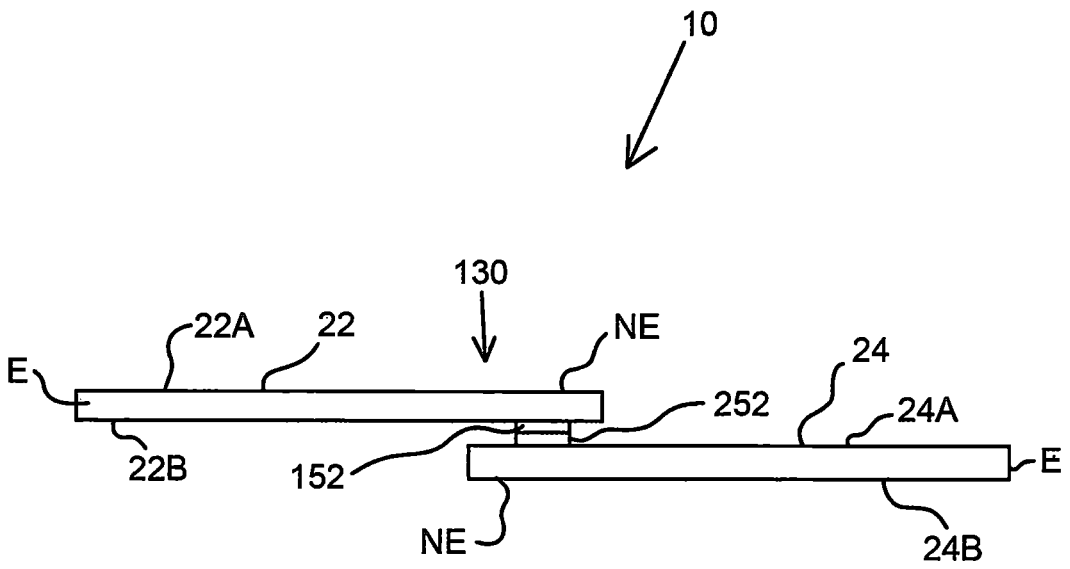
FIG. 13 is an edge view of the assembly generally as in FIG. 12, but with the forward and rearward inset magnets in mutually abutting, engaged relation so that the forward and rearward panels are pivotable on the magnetic pivot structure.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention in the various FIGURES are designated by the same reference numerals.

First Preferred Embodiment

Referring to FIGS. 1-11, a knee-cushion assembly 10 is disclosed having a cushioned forward panel 22 and a cushioned rearward panel 24 which are pivotally interconnected to fan apart to a deployed configuration for use, and to pivot into an overlapping, closed configuration for compact storage. See FIGS. 1 and 2, and 3 and 4. The panels 22 and 24 are pivotally interconnected by a pin, rivet or button, hereinafter pin structure 40, and have panel front faces 22A and 24A, respectively. When deployed, the panel front faces 22A and 24A of both panels 22 and 24 are presented and accessible so that a user can rest a knee on each, to protect the knees from the impact, pressure, discomfort and injury that can be caused by placing them directly on a hard support surface, such as a floor. The panels 22 and 24 preferably have the same shape and size, and the pin structure 40 preferably is located closely adjacent to corresponding edges E of each, so that when the panels 22 and 24 are fanned apart on the pin structure 40, the front face 24A of the rearward panel 24 is broadly exposed, and both panel front faces 22A and 24A are presented, as noted, to each support a corresponding user knee. Then they can pivot to overlap and register with each other fully in their closed configuration.

The forward and rearward panels 22 and 24 preferably are elliptically- or oval-shaped, with the pin structure 40 being located adjacent a narrow end NE of each, so that when fanned apart they cover a wide area. Forward panel 22 has a forward panel center point FC and a forward panel peripheral edge FE, and rearward panel 24 has a rearward panel center point RC and a rearward panel peripheral edge RE. An example of suitable measurements are, but are not limited to, front and back panels faces 22A, 22B, 24A and 24B each being 8 inches wide and 11.5 inches long, with the rotational axis of the pin structure 40 being located 1.5 inches from each of the forward panel edge FE and the rearward panel edge RE, at corresponding panel narrow ends NE. The overall dimensions may differ from this example, but it is preferred that the proportions, that is, the ratios of width to length and distance of the pin structure 40 from panel edge FE and RE remains substantially the same as in this example.

The panels 22 and 24 preferably are each formed of closed cell high-density, water-resistant neoprene foam. Each panel is substantially one inch thick for a consumer version, which can firmly and comfortably support knees carrying 200 pounds weight, and is substantially 1.5 inches thick for an industrial version to firmly and comfortably support knees carrying 350 pounds weight. The front face of each panel 22 and 24 preferably is covered with a protective layer PL, such as of vinyl. A logo L may be printed or otherwise displayed on the forward panel front face 22A, such as on the vinyl. The back faces 22B and 24B of each panel 22 and 24, respectively preferably is covered with a protective layer.

The pin structure 40 preferably includes a female portion 42 formed of an internally threaded tube 44 with a tube open end and a tube closed end covered by a blank tube head 46 having a width greater than the width of the tube 44, and a male portion 52 in the form of a machine screw consisting of a threaded shaft having a slotted screw head at one end. See FIG. 6. Pin structure passing holes in the form of pin passageways 62 and 64 are provided respectively in each of the forward and rearward panels 22 and 24. The panels 22 and 24 are positioned so that their pin passageways 62 and 64 mutually register, and the threaded tube 44 of the female portion 42 is fitted through the registering pin passageways 62 and 64, and the threaded shaft 54 of the male portion 52 is screwed into the internally threaded tube 44, so that the tube head 46 and the screw head 56 abut and hold the panels 22 and 24 in face-to-face abutting relation. A drop of anaerobic adhesive A is placed on the threaded shaft 54 before it is screwed into the tube 44 to prevent the male and female pivot portions 42 and 52 from loosening and disengaging.

All pin structure 40 parts preferably are formed of stainless steel. The forward and rearward ends of the pin structure 40 preferably include corresponding forward and rearward washers 22W and 24W, which fit around the internally threaded tube 44. Forward washer 22W fits between the forward panel front face 22A and the tube head 46, and preferably is 1.5 inches in diameter. Rearward washer 24W fits between rearward panel back face 24B and the screw head 56, and preferably is 0.5 inches in diameter. A center washer 23W is also provided between forward and rearward panels 22 and 24. Forward washer 22W, center washer 23W and rearward washer 24W preferably are all fender washers.

The length of the pin structure 40 preferably is less than the measure of the thicknesses of the forward and rearward panels 22 and 24 combined. In other words, by way of example, if each panel 22 and 24 is one inch thick, then of course their combined thickness is two inches. In this example, the preferred length of the pin structure 40 would be less than two inches. In this way, the first end of the pin structure 40 can be recessed into the front panel 22 so that a user knee resting on the forward panel front face 22A, over the pin structure 40, will not bear directly against pin structure 40, avoiding potential discomfort. It is also contemplated that the length of the pin structure 40 might be equal to or greater than the combined thicknesses of panels 22 and 24 but, at present, this is less preferred. The first pin passageway 62 in the forward panel 22 is counter-sunk into the forward panel front face 22A to define a forward recess 62R having a diameter matching that of the forward washer 22W into which the pin structure 40 forward end, including forward washer 22W, are seated. See FIGS. 8 and 9. The forward recess 62R is then filled with soft recess filler material FM, preferably in the form of non-sag, high strength, flexible polyurethane adhesive, which is then covered with a forward recess cover 66, preferably in the form of a circular hook and loop fastener patch 66 having a diameter matching that of the forward recess 62R. The soft filler material FM protects user knees from contact with the pin structure 40, and the filler material cover 66 protects the filler material FM from wear and tear.

Similarly, the second pin passageway 64 in the rearward panel 24 is counter-sunk into the rearward panel back face 24B to define a rearward recess 64R having a diameter matching that of the rearward washer 24W into which the pin structure 40 rearward end, including rearward washer 24W, are seated. See once again FIGS. 8-9. The rearward recess 64R is then filled with the same soft recess filler material FM used to fill forward recess 62R. Rearward recess 64R is then covered by the first mounting magnetic narrow end sheet 70 described above. Once again, the filler material FM protects the filler material FM respectively in forward and rearward recesses 62R and 64R from wear and tear.

A mounting magnet, preferably in the form of a flexible mounting sheet magnet 70, is adhesively secured to the back face 24B of the rearward panel 24, and has adequate magnetic force to removably secure and fully support the knee-cushion assembly 10 when placed against a steel surface. As a result, the assembly 10 can be stored simply by placing the rearward panel 24 against the front or side of a refrigerator or a steel tool cabinet. The mounting magnetic sheet at least partly covers the rearward panel back face 24B, and preferably is divided into separate first and second magnetic mounting end sheets 70 and 72 adhesively fastened to opposing first and second rearward panel back face narrow ends NE1 and NE2, respectively. See FIG. 6. The narrow end sheets 70 and 72 preferably cover twenty-five percent of the surface of the rearward panel back face 24B.

The magnetic mounting end sheets 70 and 72 preferably are each substantially 1/32 inches thick, and can be a 60 ml Flexible Outdoor Magnetic Sheet bonded to the back face 24B of rearward panel 24. A suitable sheet magnet 70 preferably is a thin layer of plastic, embedded with millions of magnetized steel particles, as described in "Guide to Sheet Magnet" by MAGICALLY MAGNETIC™.

To protect the magnetic mounting end sheets 70 and 72 from damage when assembly 10 is to be used on a rocky, muddy or otherwise rough or abrasive surface, a cushion cover 74 is provided. Cushion cover 74 preferably is a panel or sheet of closed cell high-density, water resistant neoprene foam, similar to that from which forward and rearward panels 22 and 24 are formed, which preferably is 3/32 inches thick and is sized and shaped to match the size and shape of the rearward panel back face 24B. See FIG. 6. The cushion cover 74 is removably secured over rearward panel back face 24B by a suitable cushion cover fastener, preferably in the form of a half inch wide first cushion cover hook and loop fastener strip 78 secured along the periphery of the cushion cover front face 76, and a corresponding half inch wide second cushion cover hook and loop fastener strip 78A secured along the periphery of the rearward panel back face 24B. First and second cushion cover hook and loop fastener strips 78 and 78A are pressed together to releasably fasten cushion cover 74 to rearward panel back face 24B to shield magnetic mounting end sheets 70 and 72.

To releasably secure the assembly 10 in its closed configuration between uses, a locking mechanism 80 preferably is provided. The preferred locking mechanism 80 includes a first locking magnetic sheet 82 secured to the forward panel back face 22B and a second locking magnetic sheet 84 secured to the rearward panel front face 24A. See FIG. 2. The first locking magnetic sheet 82 and the second locking magnetic sheet 84 are positioned on the forward and rearward panels 22 and 24, respectively to register with each other when the forward panel 22 and the rearward panel 24 are pivoted on the pin structure 40 to overlap, so that the magnetism of the first locking magnetic sheet 82 and the second locking magnetic sheet 84 releasably holds the forward and rearward panels 22 and 24 in overlapping relation. It is also contemplated that one of the first and second locking magnetic sheets 82 and 84 is a magnetized sheet, while the other is a non-magnetized steel sheet, since magnetic attraction between the two needed to perform the locking function is still present and performs the same locking function. The first locking magnetic sheet 82 preferably is located at the end of said forward panel 22 opposite the end through which the pin structure 40 passes, and the second locking magnetic sheet 84 is located at the end of said rearward panel 24 opposite the end through which the pin structure 40 passes, to give first and second locking magnetic sheets 82 an 84 maximum mechanical advantage in performing their locking function. First and second locking magnetic sheets 82 and 84 preferably have the same thickness and same manufacturer(s) as recited above for the first and second mounting magnetic narrow end sheets 70 and 72.

An alternative locking mechanism 80 includes a hook and loop fastener patch 92 secured to the front face 22A of the forward panel 22, and a hook and loop fastener strap 94 secured to the back face 24B of the rearward panel 24. See FIG. 10.

To secure assembly 10 in its closed configuration, the strap 94 is wrapped around the edges of the overlapping panels 22 and 24, and releasably secured to the patch 94. When the assembly 10 is needed for use, the user applies a small amount of force to cause the hook and loop fastener patch 92 and hook and loop fastener strap 94 to disengage, freeing the panels to fan apart into their deployed configuration.

The forward and rearward panels 22 and 24 optionally are formed of UV glow-foam to glow at night or in a dark room and recharge from ambient light during the day. The UV glow illuminates and shines through the protective layer PL.

Second Preferred Embodiment

In a second embodiment of the knee-cushion assembly 10, the pivot pin structure 40 is replaced by a magnetic pivot structure 130. See FIGS. 12-17. For this embodiment, a forward pivot structure portion 140 is mounted in a forward mounting passageway 162, forward panel forward recess 162RF and forward panel rearward recess 162RR of the forward panel 22. A rearward pivot structure portion 240 is mounted in the rearward mounting passageway 164, rearward panel rearward recess 164RF and rearward panel forward recess 164RF of the rearward panel 24. Forward pivot structure portion 140 includes a forward panel inset magnet 152 positioned at or near the forward panel back face 22B. Rearward pivot structure portion 240 includes a rearward panel inset magnet 252 positioned at or protruding from or recessed into the rearward panel front face 24A. The inset magnets 152 and 252 are oriented relative to each other so that their magnetic poles cause them to attract rather than to repel each other.

Forward and rearward panels 22 and 24 can be pivotably secured together by positioning the forward and rearward panels 22 and 24 to place the forward and rearward panel insert magnets 152 and 252 either in direct physical contact with each other, or within each other's magnetic field, so that the magnetic attraction releasably and pivotably holds the forward and rearward panels 22 and 24 together at the point of inset magnet contact. Therefore, the forward and rearward panels 22 and 24 can be pivoted relative to each other at this point of contact while the forward panel back face 22B and the rearward panel front face 24A remain in mutually abutting sliding relation or in close proximity to each other, permitting the panels 22 and 24 to fan apart and then fan back into fully overlapping relation, as described above and illustrated for the first embodiment. In this way, the pivoting, and fanning function is maintained, while permitted the panels 22 and 24 while the magnetic fields of insert magnets 152 and 252 hold them together, and insert magnets 152 and 252 can be separated from each other simply by an assembly 10 user gripping panel 22 in one hand and panel 24 in the other hand to overcome the force of magnetic attraction between and thereby separating insert magnets 152 and 252.

Figure 14:
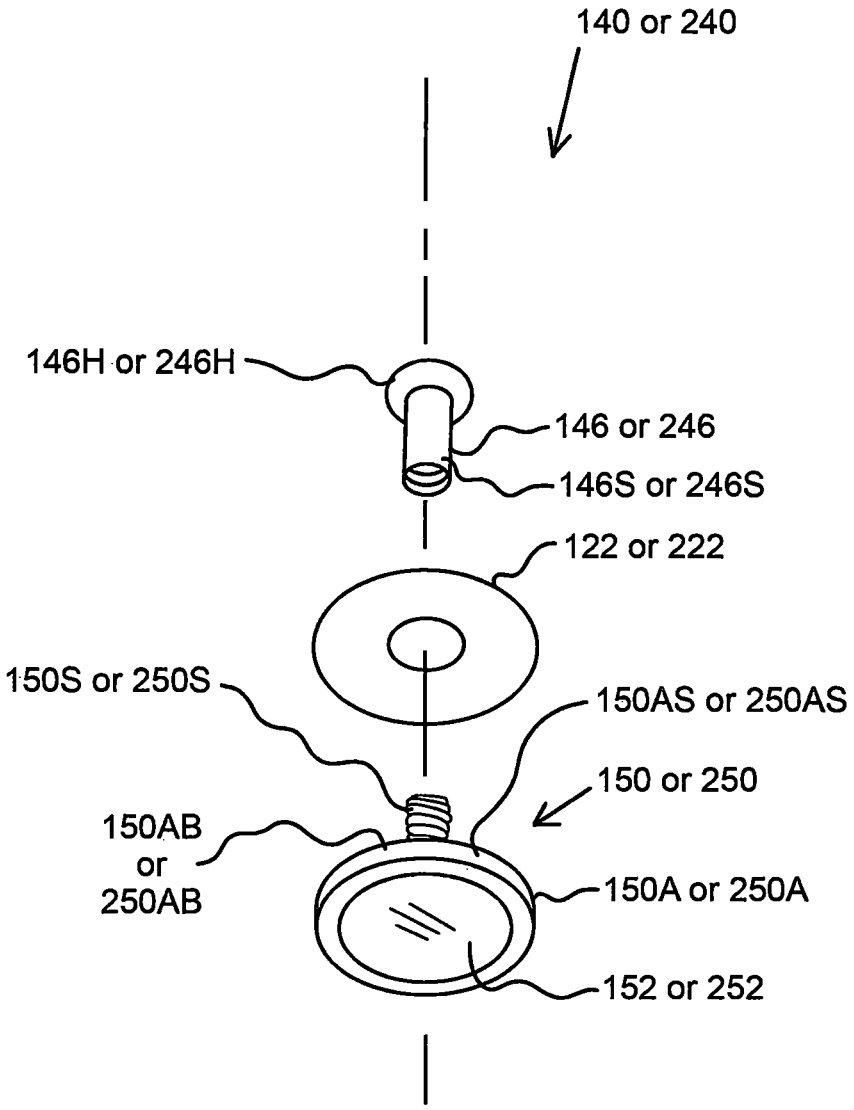
FIG. 14 is an exploded view of a preferred version of either the forward or rearward pivot structure portion.
Figure 15:
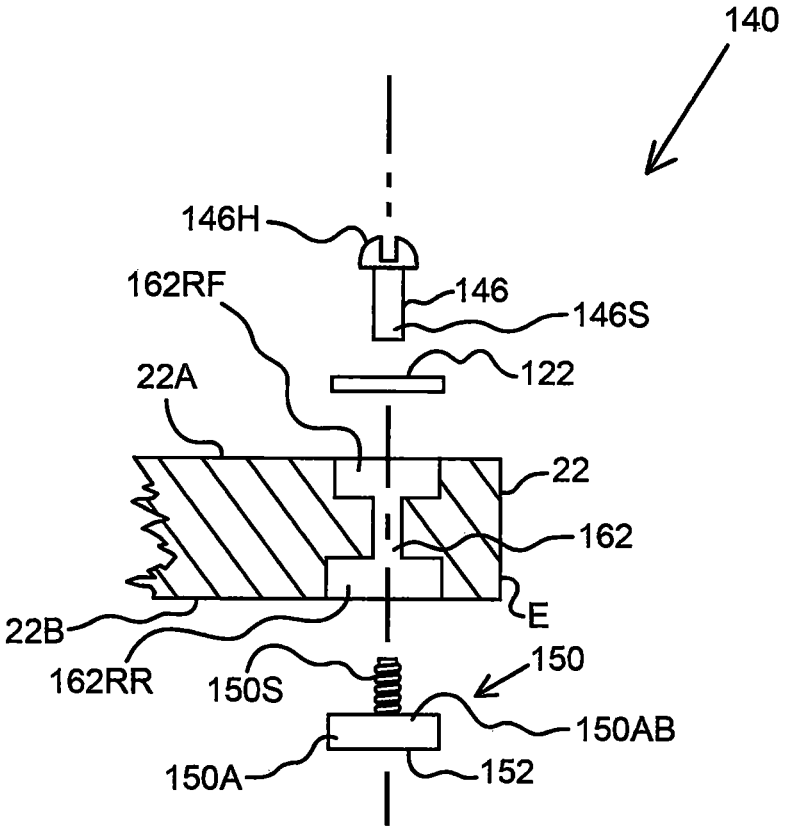
FIG. 15 is an exploded view of a broken away end of the forward panel and the forward pivot structure portion.
Figure 16:
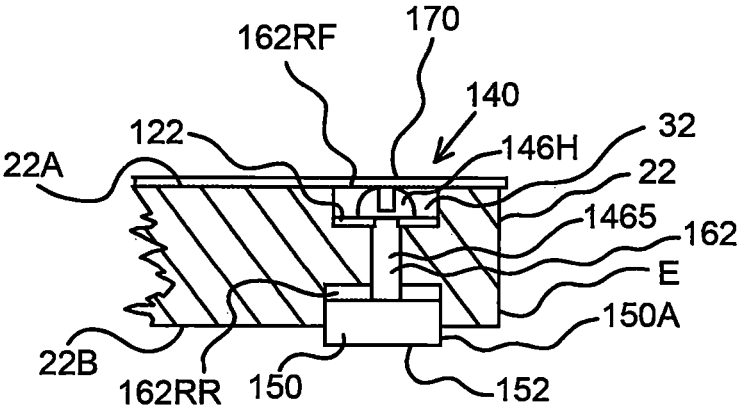
FIG. 16 is a view as in FIG. 15 with the broken away end of the forward panel and the forward pivot structure portion fully assembled.
Figure 17:
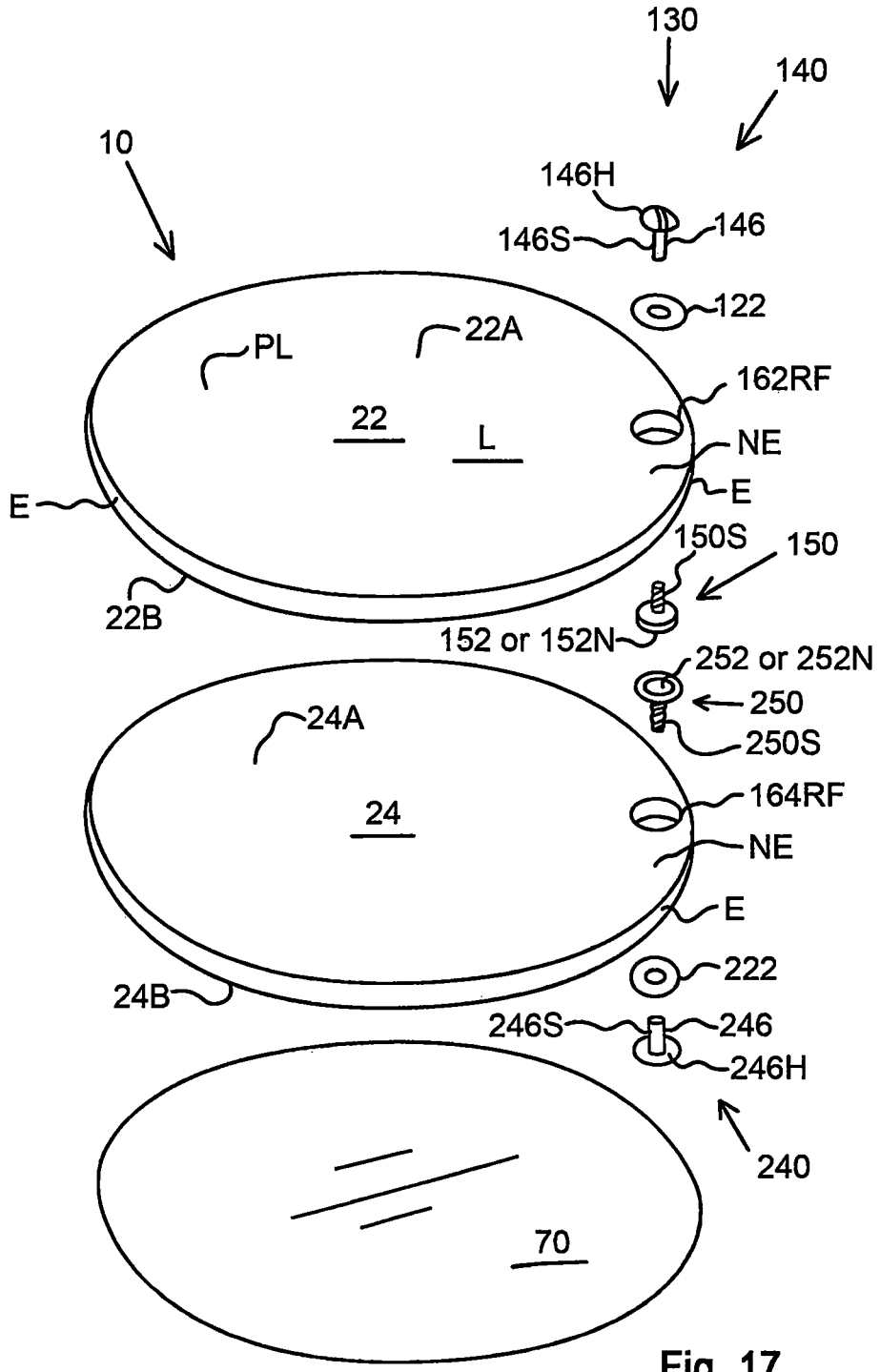
FIG. 17 is an exploded view of the entire knee-cushion assembly of the second embodiment.

The forward pivot structure portion 140, as illustrated in FIGS. 14-16, includes a forward panel tube screw 146 with a tube screw head 146H and a tubular tube screw shaft 146S, similar to the tube head 42 of the first embodiment, a forward panel washer 122, and a magnet-head screw 150. The magnet head screw 150 preferably is made of steel, and includes a screw head mounting tray 150A and a threaded shaft 150S secured to and extending perpendicularly from the back of the tray 150A. The threaded shaft 150S is secured to the tray 150A, such as by welding. The magnet-head screw mounting tray 150A preferably has a tray back wall 150AB and a tray side wall 150AS, and an inset magnet 150B which is fastened such as with an adhesive into tray 150A against tray back wall 150AB. An example of a suitable panel tube screw 146 is steel binding barrel 98002A203 by MCMASTER-CARR™, and an example of a suitable magnet head screw 150 is encased ceramic magnet threaded 5819K111 by MCMASTER-CARR™.

The forward panel tube screw 146 is fitted through forward panel washer 122 and into the forward panel 22 so that the threaded shaft 150S extends through the mounting passageway 162, and the screw head mounting tray 150A and washer 122 are seated in the forward panel rearward recess 162RR. The outward face of tray 150A and its insert magnet 150B may be flush with or recessed into the forward panel back face 22B, but preferably protrudes a sixteenth of an inch to an eighth of an inch outward from the forward panel back face 22B, to easily abut and engage the inset magnet 250B of the rearward pivot structure portion 240. The forward panel tube screw 146 is screwed onto and over the threaded shaft 150S, passing through forward panel washer 122 so that the tube screw head 146H firmly abuts washer 122, and washer 122 firmly abuts the bottom of forward panel forward recess 162RF. It is alternatively contemplated that washer 122 be omitted if the tube head 146H is sufficiently wide to perform the load distributing function of forward panel washer 122.

A plug of cushion material 32 preferably is fitted and glued into the forward panel forward recess 162RF, covering the forward panel tube screw head 146H and washer 122 and flush with the forward panel front face 22A, to shield a user knee from bearing directly against the tube screw head 146H. In addition, or alternatively, a magnetic sheet 170, similar to first mounting magnetic sheet 70, preferably is adhesively secured over the forward panel front face 22A at the narrow end NE to cover the area of the forward panel forward recess 162RF, to further shield a user knee and to provide a magnet on which to mount small steel items while the assembly 10 is mounted against a steel support surface, if desired.

The rearward pivot structure portion 240, as illustrated in FIG. 14, includes a rearward panel tube screw 246 with a tube screw head 246H and tubular tube screw shaft 246S, a rearward panel washer 222, and a magnet-head screw 250. The magnet head screw 250 preferably is made of steel, and includes a screw head mounting tray 250A and a threaded shaft 250S secured to and extending perpendicularly from the back of the tray 250A. The threaded shaft 250S is secured to the tray 250A, such as by welding. The magnet-head screw mounting tray 250A preferably has a tray back wall 250AB and a tray side wall 250AS, and an inset magnet 250B which is fastened, again such as with an adhesive into tray 250A against tray back wall 250AB.

The rearward panel tube screw 246 is fitted through a rearward panel washer 222 and into the rearward panel 24 so that the threaded shaft 250S extends through the mounting passageway 164, and the screw head mounting tray 250A and washer 222 are seated in the rearward panel rearward recess 164RR. The outward face of tray 250A and its insert magnet 250B may be flush with or recessed into the rearward panel front face 24A, but preferably protrudes a sixteenth of an inch to an eighth of an inch outward from the forward panel back face 22B, to easily abut and engage the inset magnet 150B of the forward pivot structure portion 140. The rearward panel tube screw 246 is screwed onto and over the threaded shaft 252, passing through rearward panel washer 222 so that the tube screw head 246H firmly abuts washer 222, and washer 222 firmly abuts the bottom of rearward panel rearward recess 164RR. It is alternatively contemplated that washer 222 be omitted if the tube head 246H is sufficiently wide to perform the load distributing function of rearward panel washer 222.

It is contemplated that either one, but of course not both, of inset magnets 152 and 252 can be replaced with a magnetic non-magnetized element 150N or 250N that is simply attracted to the remaining inset magnet, a magnetic non-magnetized element 150N or 250N being a quantity of material which is attracted to a magnet but is not itself a magnet, such as a piece of iron or steel that is not magnetized. See FIG. 17. For this version, the remaining inset magnet 152 or 252 provides the magnetic field to cause the magnetic attraction needed to releasably and pivotally hold the forward and rearward panels 22 and 24 together as is accomplished by inset magnets 152 and 252 as described above. Therefore, the two possibilities for this version are to provide inset magnet 152 and a magnetic non-magnetized element 252N, or a magnetic non-magnetized element 152N and inset magnet 252.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a magnetic pivot structure including a forward pivot structure portion secured to said forward panel at a point between said forward panel center point and said forward panel peripheral edge, wherein said forward pivot structure portion comprises a magnet;

and a rearward pivot structure portion secured to said rearward panel at a point between said rearward panel center point and said rearward panel peripheral edge, wherein said rearward pivot structure portion comprises one of a magnet and a magnetic non-magnetized element;

such that said forward panel and said rearward panel are pivotally and releasably interconnected by magnetic attraction between said forward pivot structure portion and said rearward pivot structure portion to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests.

2. The knee-cushion assembly of claim 1, wherein said forward pivot structure portion comprises a forward panel tube screw with a tube screw head and a tubular tube screw shaft, a forward panel washer, and a magnet-head screw, said magnet head screw including a screw head mounting tray and a threaded shaft secured to and extending perpendicularly from the back of the tray, the threaded shaft being secured to the tray, and said magnet being fastened to said tray and facing outwardly from said forward panel; and wherein said rearward pivot structure portion comprises a rearward panel tube screw with a tube screw head and a tubular tube screw shaft, a rearward panel washer, and a magnet-head screw, said magnet head screw including a screw head mounting tray and a threaded shaft secured to and extending perpendicularly from the back of the tray, the threaded shaft being secured to the tray, and said one of a magnet and a magnetic non-magnetized element being fastened to said tray and facing outwardly from said rearward panel.

3. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a magnetic pivot structure including a forward pivot structure portion secured to said forward panel at a point between said forward panel center point and said forward panel peripheral edge, wherein said forward pivot structure portion comprises one of a magnet and a magnetic non-magnetized element;

and a rearward pivot structure portion secured to said rearward panel at a point between said rearward panel center point and said rearward panel peripheral edge, wherein said rearward pivot structure portion comprises a magnet;

such that said forward panel and said rearward panel are pivotally and releasably interconnected by magnetic attraction between said forward pivot structure portion and said rearward pivot structure portion to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests.

4. The knee-cushion assembly of claim 3, wherein said forward pivot structure portion comprises a forward panel tube screw with a tube screw head and a tubular tube screw shaft, a forward panel washer, and a magnet-head screw, said magnet head screw including a screw head mounting tray and a threaded shaft secured to and extending perpendicularly from the back of the tray, the threaded shaft being secured to the tray, and said one of a magnet and a magnetic non-magnetized element being fastened to said tray and facing outwardly from said forward panel; and wherein said rearward pivot structure portion comprises a rearward panel tube screw with a tube screw head and a tubular tube screw shaft, a rearward panel washer, and a magnet-head screw, said magnet head screw including a screw head mounting tray and a threaded shaft secured to and extending perpendicularly from the back of the tray, the threaded shaft being secured to the tray, and said magnet being fastened to said tray and facing outwardly from said rearward panel.

5. The knee-cushion assembly of claim 1, wherein said forward panel has the same peripheral shape and size as said rearward panel.

6. The knee-cushion assembly of claim 1, wherein said magnetic pivot structure engages each of said forward panel adjacent to said forward panel peripheral edge and said rearward panel adjacent to said rearward panel peripheral edge;

such that when said forward panel and said rearward panel are fanned apart on said magnetic pivot structure, said forward panel front face and said rearward panel front face are each exposed and presented for use in supporting user knees.

7. The knee-cushion assembly of claim 1, additionally comprising a logo displayed on said forward panel front face.

8. The knee-cushion assembly of claim 1, wherein, when said forward panel and said rearward panel are magnetically connected with the forward panel back face in contact with the rearward panel front face, said magnetic pivot structure has a length equal to the combined thickness of said forward and rearward panels.

9. The knee-cushion assembly of claim 1, additionally comprising a locking mechanism for releasably holding said knee cushion assembly in its closed configuration.

10. The knee-cushion assembly of claim 9 wherein said locking mechanism comprises a hook and loop fastener patch secured to said forward panel front face, and a hook and loop fastener strap secured to said rearward panel back face;

such that, to secure said knee-cushion assembly in its closed configuration, said fastener strap is wrapped around the edges of said forward and rearward panels while said forward and rearward panels overlap, and is releasably secured to said fastener patch, and such that when said knee-cushion assembly is needed for use, a user applies a small amount of force to cause said fastener patch and said fastener strap to disengage, freeing said forward and rearward panels to fan apart into its open configuration.

* * * * *